US012102126B2

(12) United States Patent
Chen et al.

(10) Patent No.: US 12,102,126 B2
(45) Date of Patent: Oct. 1, 2024

(54) ELECTRONIC ATOMIZER, ELECTRONIC ATOMIZER ASSEMBLY METHOD, AND ELECTRONIC CIGARETTE

(71) Applicant: SHENZHEN EVERWIN PRECISION TECHNOLOGY CO., LTD., Guangdong (CN)

(72) Inventors: Xiaoshuo Chen, Guangdong (CN); Su Lu, Guangdong (CN); Yayong Li, Guangdong (CN)

(73) Assignee: SHENZHEN EVERWIN PRECISION TECHNOLOGY CO., LTD., Guangdong (CN)

( * ) Notice: Subject to any disclaimer, the term of this patent is extended or adjusted under 35 U.S.C. 154(b) by 621 days.

(21) Appl. No.: 17/362,281

(22) Filed: Jun. 29, 2021

(65) Prior Publication Data

US 2021/0321671 A1 Oct. 21, 2021

Related U.S. Application Data

(63) Continuation of application No. PCT/CN2020/087466, filed on Apr. 28, 2020.

(30) Foreign Application Priority Data

Jul. 23, 2019 (CN) ..... 201910666763.2
Jul. 23, 2019 (CN) ..... 201910666768.5
(Continued)

(51) Int. Cl.
*A24F 40/46* (2020.01)
*A24F 40/10* (2020.01)
*A24F 40/42* (2020.01)

(52) U.S. Cl.
CPC ..... *A24F 40/46* (2020.01); *A24F 40/10* (2020.01); *A24F 40/42* (2020.01)

(58) Field of Classification Search
None
See application file for complete search history.

(56) References Cited

U.S. PATENT DOCUMENTS

2010/0200008 A1 8/2010 Taieb
2012/0118307 A1 5/2012 Tu
(Continued)

FOREIGN PATENT DOCUMENTS

CN 203538370 U 4/2014
CN 104287096 A 1/2015
(Continued)

OTHER PUBLICATIONS

Office Action issued Aug. 3, 2023 in CN 201910667601.0.
(Continued)

*Primary Examiner* — Oscar C Jimenez
(74) *Attorney, Agent, or Firm* — W&G Law Group

(57) ABSTRACT

An electronic atomizer includes a cartridge tube provided with an e-liquid storage cavity and a flue, a closure member closing the e-liquid storage cavity, a sealing member, an atomizing core provided in the closure member, and a base. The closure member includes a closure end, an accommodation end extending downward from closure end, a flow passage vertically penetrating through closure member, and an air passage separated from flow passage; the sealing member is integrally formed on closure member and includes a first sealing portion covering outer side of the atomizing core, a second sealing portion covering outer periphery of the closure end and abutting against inner wall surface of the cartridge tube, and a third sealing portion fitted to top end of the air passage and abutting against end edge of the flue; the e-liquid storage cavity communicates with upper end surface of atomizing core through the flow passage.

20 Claims, 6 Drawing Sheets

(30) Foreign Application Priority Data

Jul. 23, 2019 (CN) ..... 201910666798.6
Jul. 23, 2019 (CN) ..... 201910667601.0

(56) References Cited

U.S. PATENT DOCUMENTS

| | | | | |
|---|---|---|---|---|
| 2022/0192270 | A1* | 6/2022 | Zeng | A24F 40/10 |
| 2022/0202086 | A1* | 6/2022 | Zhou | A24F 40/46 |
| 2022/0202093 | A1* | 6/2022 | Zhou | A24F 40/485 |
| 2022/0248756 | A1* | 8/2022 | Chen | A24F 40/48 |
| 2022/0256925 | A1* | 8/2022 | Zhang | A24F 40/44 |
| 2023/0092179 | A1* | 3/2023 | He | H05B 3/26 131/329 |
| 2023/0218005 | A1* | 7/2023 | Liu | A24F 40/10 131/329 |

FOREIGN PATENT DOCUMENTS

| | | | |
|---|---|---|---|
| CN | 204120222 | U | 1/2015 |
| CN | 204120224 | U | 1/2015 |
| CN | 205757175 | U | 12/2016 |
| CN | 206005949 | U | 3/2017 |
| CN | 206062138 | U | 4/2017 |
| CN | 107006896 | A | 8/2017 |
| CN | 107010998 | A | 8/2017 |
| CN | 107173849 | A | 9/2017 |
| CN | 107182139 | A | 9/2017 |
| CN | 107650326 | A | 2/2018 |
| CN | 207185916 | U | 4/2018 |
| CN | 207341185 | U | 5/2018 |
| CN | 108308716 | A | 7/2018 |
| CN | 108379702 | A | 8/2018 |
| CN | 207784285 | U | 8/2018 |
| CN | 109007980 | A | 12/2018 |
| CN | 109393566 | A | 3/2019 |
| CN | 109452691 | A | 3/2019 |
| CN | 109527657 | A | 3/2019 |
| CN | 109531913 | A | 3/2019 |
| CN | 208550032 | U | 3/2019 |
| CN | 110403248 | A | 11/2019 |
| CN | 110447960 | A | 11/2019 |
| CN | 110447961 | A | 11/2019 |
| CN | 110477455 | A | 11/2019 |
| CN | 211020987 | U | 7/2020 |
| CN | 211021000 | U | 7/2020 |
| CN | 211323052 | U | 8/2020 |
| WO | WO 2016/090426 | A1 | 6/2016 |

OTHER PUBLICATIONS

International Search Report from International Application No. PCT/CN2020/087466 mailed Jul. 22, 2020.
Search Report issued Jan. 19, 2021 in CN 201910666768.5.
Office Action issued Jan. 28, 2021 in CN 201910666768.5.
First Office Action issued Feb. 1, 2024 in CN 201910666798.6.
First Office Action issued Jan. 23, 2024 in CN 201910666763.2.
Notice of Second Review Opinion, issued Feb. 5, 2024 in CN 201910667601.0.
Second Office Action issued Feb. 5, 2024 in CN 201910667601.0.

* cited by examiner

ELECTRONIC ATOMIZER, ELECTRONIC ATOMIZER ASSEMBLY METHOD, AND ELECTRONIC CIGARETTE

CROSS-REFERENCE TO RELATED APPLICATIONS

This patent application is a continuation of International Application No. PCT/CN2020/087466, filed on Apr. 28, 2020, which claims priority to and the benefit of Chinese Patent Application Nos. 201910666798.6, 201910667601.0, 201910666768.5, and 201910666763.2 each filed on Jul. 23, 2019. The disclosures of the aforementioned applications are hereby incorporated by reference in their entireties.

TECHNICAL FIELD

The present disclosure relates to the field of electronic cigarettes, and in particular, to an electronic atomizer, an electronic atomizer assembly method, and an electronic cigarette.

BACKGROUND

Patent Application No. 201811033876.0 of the People's Republic of China discloses an atomizer and an electronic cigarette, including an atomizing core, a first plastic member assembling the atomizing core, a second plastic member, a housing sleeving an exterior of the first plastic member, and a cover body snapped with the housing and covering an exterior of the second plastic member. A first sealing portion is clamped between the atomizing core and the first plastic member, and a second sealing portion is clamped between a periphery of the first plastic member and the housing. The first plastic member is further provided with an air hole. The housing is provided with an air passage communicated with the air hole. The air hole is connected to the air passage, and a third sealing member is clamped between the two. The first, second, and third sealing members are provided to prevent e-liquid from leaking from the housing. The three sealing members are provided independently and need to be assembled between corresponding parts and components. Moreover, the sealing members are made of silica gel materials, which are soft and difficult to achieve automatic production, and need to be manually assembled. As a result, manufacturing efficiency is low, and it is difficult to guarantee the quality.

SUMMARY

In view of this, there is a need to provide an electronic atomizer, an electronic atomizer assembly method, and an electronic cigarette, which can prevent seepage and facilitate automatic assembly.

In order to solve the above technical problems, provided is an electronic atomizer, including: a cartridge tube provided with an e-liquid storage cavity and a flue, a closure member closing the e-liquid storage cavity, a sealing member, an atomizing core provided in the closure member, and a base; the closure member including a closure end, an accommodation end extending downward from the closure end, a flow passage vertically penetrating through the closure member, and an air passage separated from the flow passage, wherein the sealing member is integrally formed on the closure member, and the sealing member includes: a first sealing portion covering an outer side of the atomizing core, a second sealing portion covering an outer periphery of the closure end and abutting against an inner wall surface of the cartridge tube, and a third sealing portion fitted to a top end of the air passage and abutting against an end edge of the flue; and the e-liquid storage cavity is communicated with an upper end surface of the atomizing core through the flow passage.

Provided is an assembly method of an electronic atomizer, including the following steps:

S10, providing a closure member with a sealing member, an atomizing core provided with a heating element at a bottom surface, and a base; and the atomizing core being accommodated between the closure member and the base, the sealing member including a first sealing portion clamped between the atomizing core and the closure member, the base being provided with an air hole and an electrode electrically connected to the heating element of the atomizing core, and the closure member being provided with a flow passage and an air passage independent of the flow passage;

S20, providing a cartridge tube, the cartridge tube being provided with an e-liquid storage cavity and a flue; and injecting e-liquid into the e-liquid storage cavity of the cartridge tube; and S30, inserting an assembly obtained in S10 into the cartridge tube to close the cartridge tube, the flow passage being communicated with the e-liquid storage cavity and the atomizing core; the air passage being communicated with the flue and the air hole, the sealing member further including a second sealing portion clamped between an outer periphery of the closure member and an inner wall surface of the cartridge tube and a third sealing portion clamped between an inner wall surface of a top end of the air passage and an outer wall surface of a free end of the cartridge tube.

Provided is an electronic cigarette, including a cigarette pole and an electronic atomizer inserted to the cigarette pole; the electronic atomizer including: a cartridge tube provided with an e-liquid storage cavity and a flue, a closure member closing the e-liquid storage cavity, a sealing member, an atomizing core provided in the closure member, and a base; the closure member including a closure end, an accommodation end extending downward from the closure end, a flow passage vertically penetrating through the closure member, and an air passage separated from the flow passage; wherein a bottom surface of the atomizing core is provided with a heating element, and the base is provided with electrodes electrically connected to the heating element; at least four of the electrodes are electrically connected to contact points of the heating element, and a circuit of the cigarette pole is electrically connected to at least two of the electrodes to enable the electronic atomizer to be applicable to different cigarette poles to achieve different flavors.

Provided is an atomizing device, including: an atomizing core and a closure member, wherein the atomizing core is integrally formed in the closure member, the atomizing core includes a ceramic matrix and a ceramic core located inside the ceramic matrix, the ceramic matrix is made of zirconia ceramic, the ceramic core is made of porous ceramic, the ceramic matrix includes a frame body and a core cavity vertically penetrating through the frame body, the porous ceramic is located in the core cavity, the closure member includes an outer wall, and an outer surface of the ceramic matrix and an inner side surface of the outer wall are integrally formed and form a joint surface.

Details of one or more embodiments of the present disclosure are set forth in the accompanying drawings and the description below. Other features, objectives, and advantages of the present disclosure will be apparent from the description, the drawings, and the claims.

BRIEF DESCRIPTION OF DRAWINGS

The accompanying drawings described herein are used to provide further illustration of the present disclosure, and constitute a part of the present disclosure. Schematic embodiments of the present disclosure and description thereof are used to explain the present disclosure, and do not constitute improper limitations on the present disclosure.

DESCRIPTION OF EMBODIMENTS

To make the objectives, technical solutions, and advantages of the present disclosure clearer, the following clearly and completely describes the technical solutions of the present disclosure with reference to specific embodiments and corresponding accompanying drawings in the present disclosure.

Embodiment 1

Figure 1:
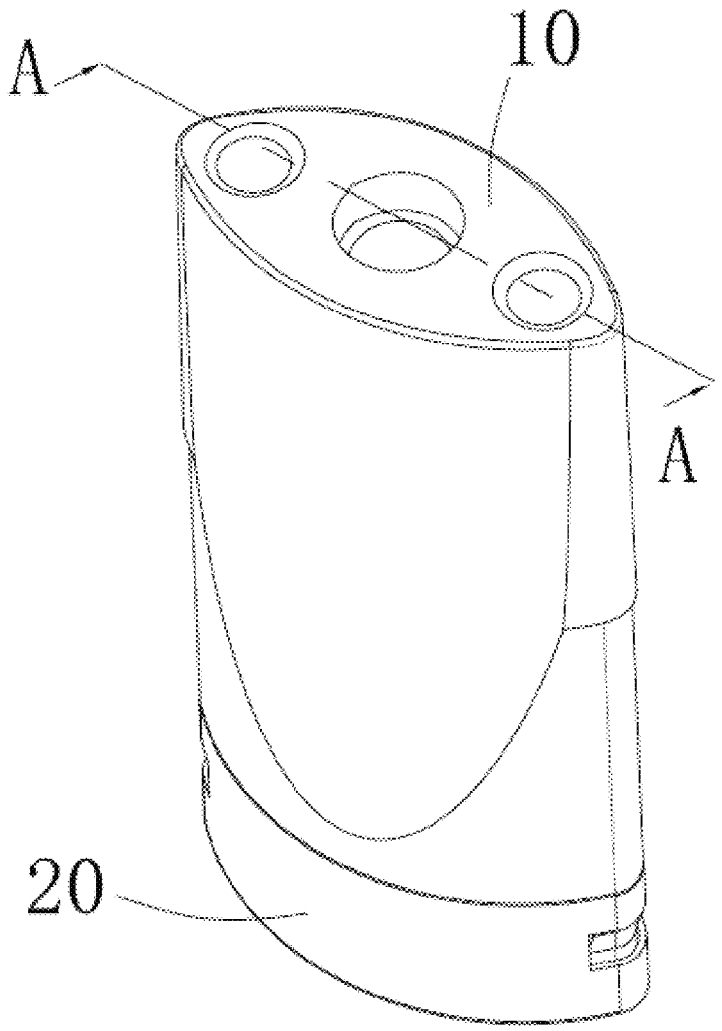
FIG. 1 is a perspective view of an atomizing device according to the present disclosure.
Figure 2:
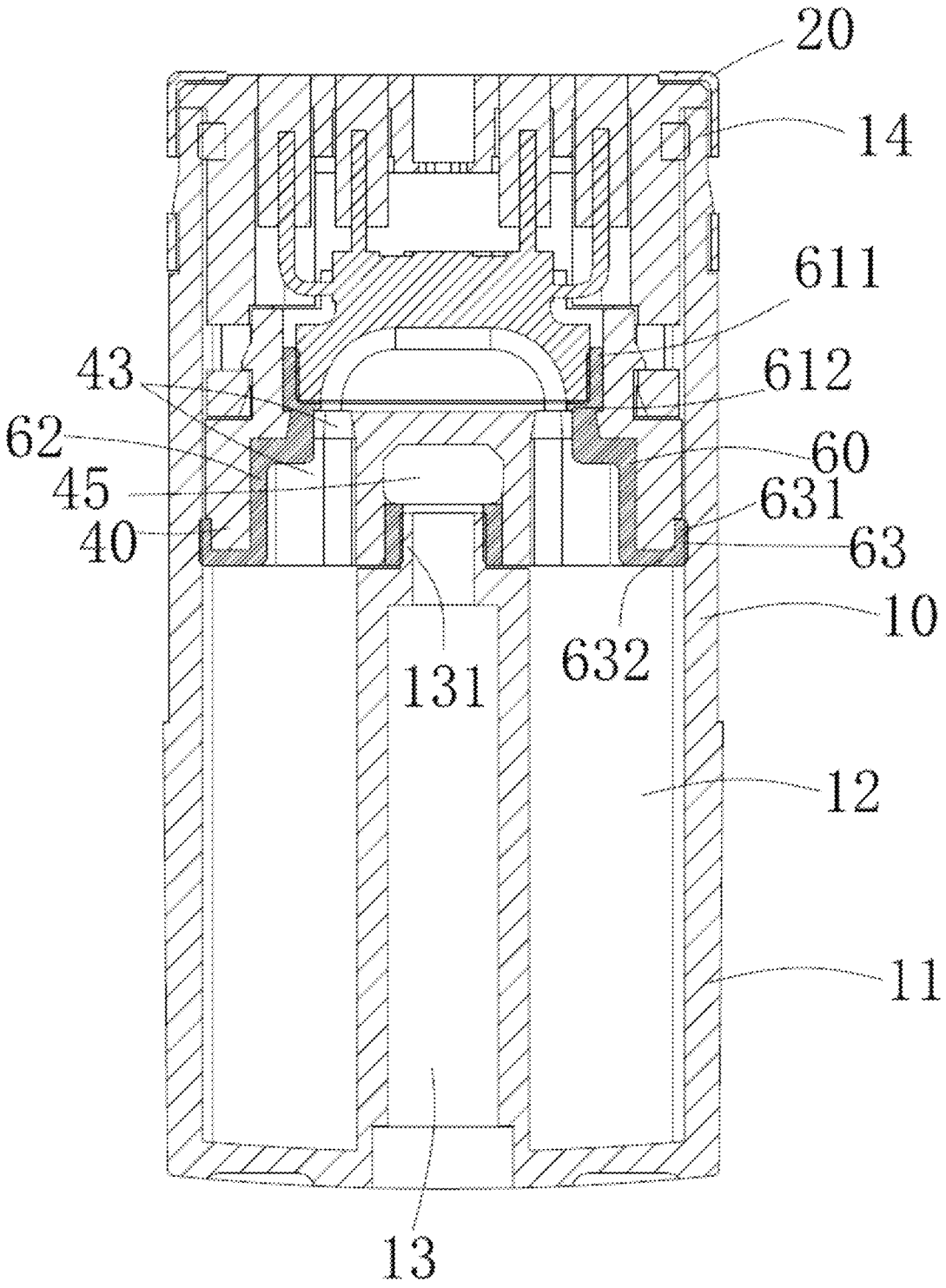
FIG. 2 is a cross-sectional view taken along a dashed line A-A in FIG. 1.
Figure 3:
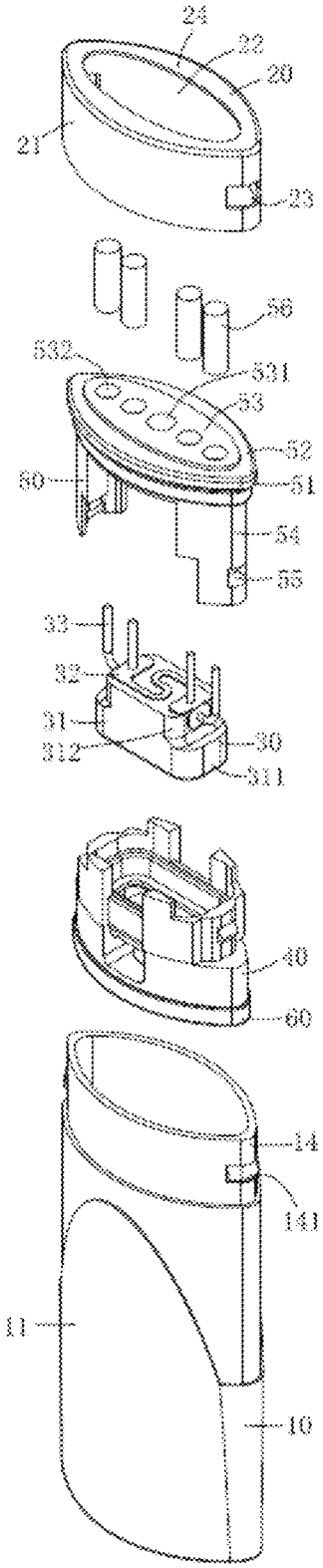
FIG. 3 is an exploded perspective view of the atomizing device according to the present disclosure.
Figure 4:
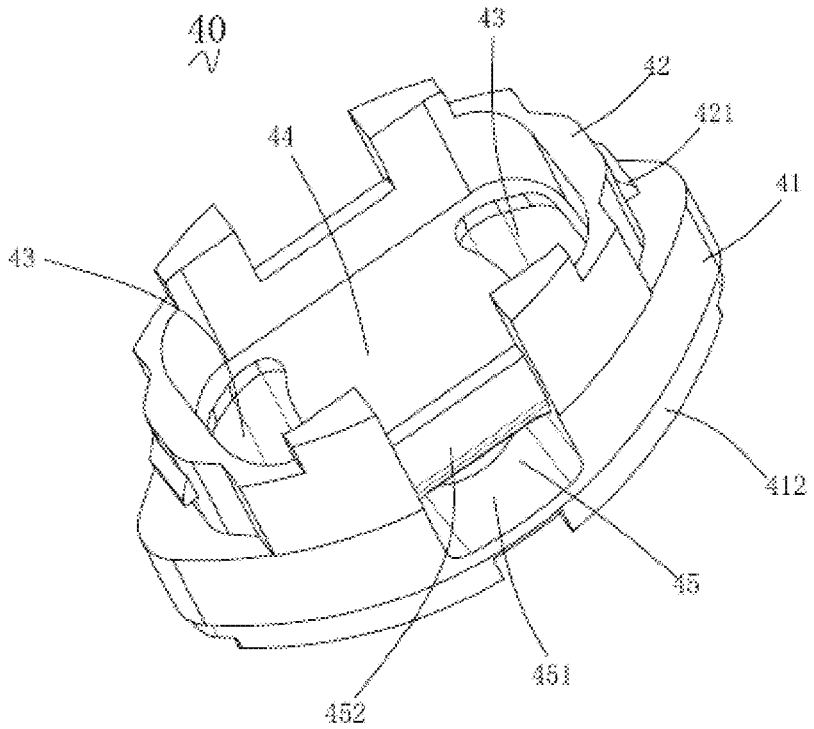
FIG. 4 is a perspective view of a closure member of the atomizing device according to the present disclosure.
Figure 5:
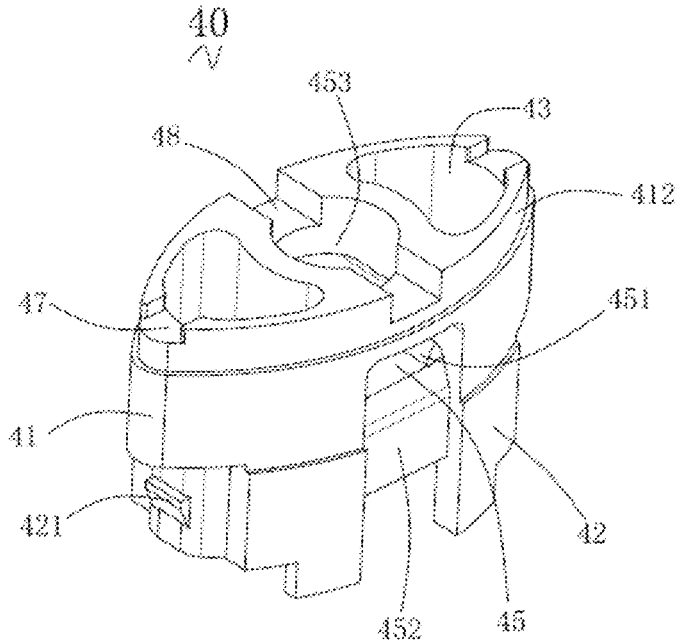
FIG. 5 is another perspective view of the closure member of the atomizing device according to the present disclosure.

Referring to FIG. 1 to FIG. 3, the atomizing device of the present disclosure includes a cartridge tube 10 provided with a flue 13 and an e-liquid storage cavity 12, a closure member 40 mounted in the cartridge tube 10 and closing the e-liquid storage cavity 12, a sealing member 60 formed in the closure member 40, an atomizing core 30 provided at a lower end of the closure member 40, a base 50 snapped with the closure member 40 to clamp the atomizing core 30, and a cover body 20 sleeving a periphery of the base 50 and snapped with the cartridge tube 10.

The base 50 and the cover body 20 may be designed into an integrated structure, that is, the base 50 is directly snapped with the cartridge tube 10.

Referring to FIG. 2 and FIG. 3, the cartridge tube 10 includes a tube body 11, a mating end 14 located at a top of the tube body 11, a first snapping portion 141 disposed at two sides of the mating end 14, an e-liquid storage cavity 12 located in the tube body 11, and a flue 13 penetrating through a bottom of the tube body 11. A top end of the flue 13 is provided with a connection portion 131. An outer diameter of the connection portion 131 is smaller than an outer diameter of the flue 13. Preferably, the flue 13 is located at the middle of the e-liquid storage cavity 12. In specific implementation, the flue may also be disposed at one side or two sides of the e-liquid storage cavity 12.

Still referring to FIG. 2 to FIG. 5, the closure member 40 includes a closure end 41 and an accommodation end 42 extending downward from the closure end 41. A top outer edge of the closure end 41 is provided with a closure groove 412. The accommodation end 42 is provided with an accommodation cavity 44 toward a direction of the atomizing core 30. The closure member 40 further includes: a flow passage 43 vertically penetrating through the closure end 41 and communicated to the accommodation cavity 44, and an air passage 45 independent of the flow passage and not communicated to the accommodation cavity 44. The air passage 45 includes: a connection air passage 453 vertically penetrating through the closure end 41, a traverse air passage 451 non-vertically penetrating through the closure end 41, and an outer-side air passage 452 extending downward at an outer wall of the accommodation end 42 from the traverse air passage 451. A traverse outer side of the accommodation end 42 is provided with a second snapping portion 421. The connection air passage 453 of the closure member 40 extends outward to form a first groove 48 at a position different from the flow passage 43. An outer side of the flow passage 43 of the closure member 40 extends to form a second groove 47.

Figure 7:
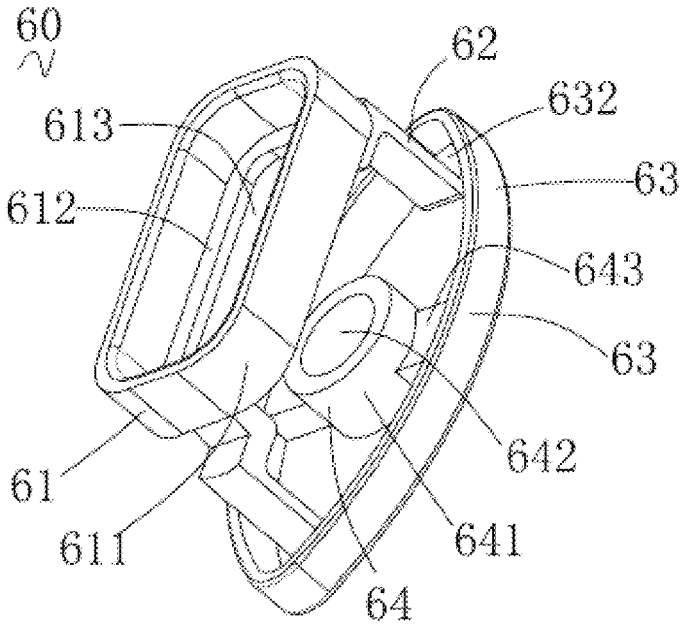
FIG. 7 is a perspective view of a sealing member of the atomizing device according to the present disclosure.

Still referring to FIG. 2, FIG. 3, and FIG. 7, the sealing member 60 is integrally formed on the closure member 40. Specifically, the sealing member 60 includes a first sealing portion 61 formed in the accommodation cavity 44, a second sealing portion 63 formed on an outer periphery of the closure groove 412 at a top outer edge of the closure end 41, and a third sealing portion 64 formed at an inner wall of the connection air passage 453 of the closure member 40.

The first sealing portion 61 includes a first fitting portion 611 formed around an inner wall of the accommodation cavity 44, an opening 613 vertically penetrating through the first sealing portion 61, and a second fitting portion 612 formed at an outer periphery of the opening 416 and fitted to a bottom wall of the accommodation cavity 44. A plane where the first sealing portion 611 is located is perpendicular with a plane where the second fitting portion 612 is located. The second sealing portion 63 includes a third fitting portion 631 fitted to the outer periphery of the closure groove 412 and a fourth fitting portion 632 covering an outer periphery of an end edge of the closure end 41. The third sealing portion 64 includes: a fifth fitting portion 641 fitted to an inner wall surface of the connection air passage 453, and a through hole 642 formed at the middle of the third sealing portion 64.

A first connecting portion 62 is connected between the first sealing portion 61 and the second sealing portion 63. The first connecting portion 62 extends upward from an outer side wall of the flow passage 43 to the second groove 47 formed at a top outer side of the flow passage 43 to be connected to the fourth fitting portion 632. A second connecting portion 643 is connected between the second sealing portion 63 and the third sealing portion 64. The second connecting portion 643 extends along the first groove 48 and is connected to outer side walls of the fourth fitting portion 632 and the fifth fitting portion 641.

In specific implementation, the first, second, and third sealing portions 61, 63, and 64 may also be provided independently, without being connected through the first and second connecting portions 62 and 643. In this case, when the sealing member 60 is injection-molded, three injection points need to be provided respectively corresponding to the first, second, and third sealing portions 61, 63, and 64. In this case, the configuration of a mold for injection molding is relatively complicated. With the first and second connecting portions 62 and 643 being the flow passage of silica gel liquid, only one injection point needs to be provided.

In another embodiment, the first connecting portion 62 may be omitted, only the second connecting portion 643 is remained, the second sealing portion 63 and the third sealing portion 64 are located in a same plane, and the provision of one injection point will not affect a flow rate of the silica gel liquid and will not lead to an unsaturated mold.

During injection molding, firstly, the closure member 40 is injection-molded, and upon completion of the injection molding of the injection-molded part 40, part of the mold for the injection molding may be shared when subsequently injection molding of the sealing member 60. In this case, it only needs to remove mold parts filling a reserved region from a part needing silicone molding, and then the silica gel liquid can be injected to form the sealing member 60.

Figure 6:
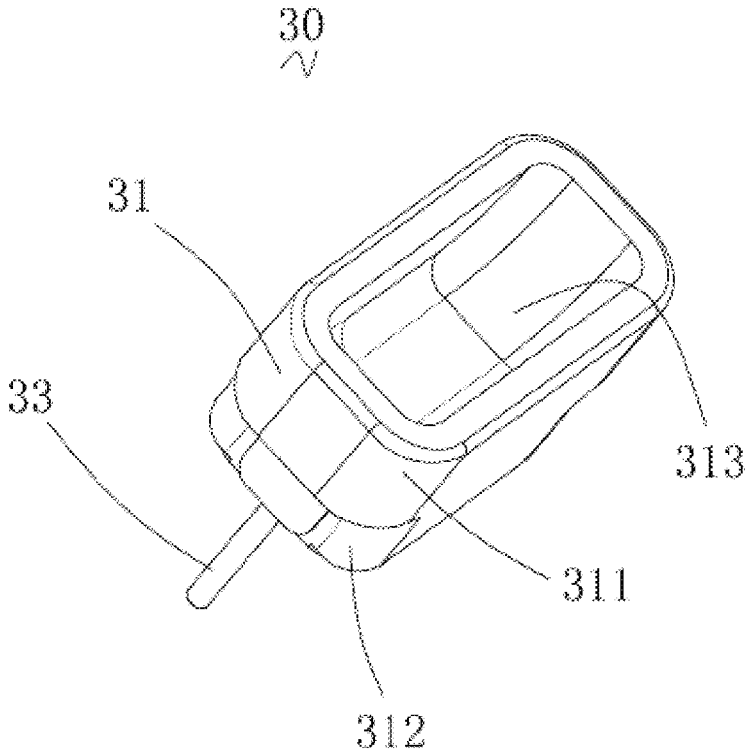
FIG. 6 is a perspective view of an atomizing core of the atomizing device according to the present disclosure.

Still referring to FIG. 3 and FIG. 6, the atomizing core 30 is made of porous ceramic, and includes a ceramic matrix 31, a heating element 32 affixed to a bottom of the ceramic matrix 31, and a lead wire 33 connected to the heating element 32. The ceramic matrix 31 includes a head 311 and a tail 312 extending from the head 311. The head 311 is installed into the first sealing portion 61 of the sealing member 60, and an outer edge of the head 311 mates with an inner wall of the accommodation cavity 44 to clamp the first fitting portion 611 of the first sealing portion 61. A top end of the head 311 is further provided with an e-liquid storage tank 313. A peripheral top surface of the e-liquid storage tank 313 is fitted to the second fitting portion 612. The e-liquid storage tank 313 is communicated to the e-liquid storage cavity 12 of the cartridge tube 10 through the flow passage 43 and the opening 613. E-liquid in the e-liquid storage cavity 12 flows into the e-liquid storage tank 313 through the flow passage 43 and the opening 613. The e-liquid in the e-liquid storage tank 313 seeps out, by capillarity, through a capillary hole in the ceramic matrix 31 to a surface where the heating element 32 is located for atomization. A traverse width of the tail 32 is smaller than a traverse width of the head 31. The heating element 32 extends from a bottom surface and two side surfaces of the tail 32, and four lead wires 33 are respectively led out from the bottom surface and the two side surfaces.

The base 50 includes a body portion 51, a clamping portion 54 extending from two sides of the body portion 51 toward the closure member 40, and a plurality of electrodes 56 formed in the body portion 51. The body portion 51 vertically penetrates to form an air inlet hole 531 communicated with the outer-side air passage and a plurality of terminal holes 532 accommodating the electrodes 56. The electrodes 56 pass through the terminal holes 532 and are exposed to an end face of the body portion 51. The lead wires 33 are respectively electrically connected to the electrodes 56. The clamping portion 54 is provided with a third snapping portion 55 snapped with the second snapping portion 421 of the closure member 40. The middle of the end face of the body portion 51 protrudes upward to form a protruding portion 53 and a recessed escape groove 52 located at an outer edge of the protruding portion 53. The terminal holes 532 and the air inlet hole 531 are formed in the protruding portion 53.

In specific implementation, an elastic contact portion is provided at an end of the electrode 56 facing the atomizing core 30, and the elastic contact portion directly abuts against the heating element 32 at a bottom surface of the atomizing core 30. In this case, the lead wire 33 is no longer needed. Four electrodes 56 are provided to select different control programs and flavors corresponding to different cigarette poles.

The cover body 20 includes a cylindrical body 21, a fourth snapping portion 23 disposed at two sides of the cylindrical body 21 and snapped with the first snapping portion 141, an escape port 22 formed at an end face of the cylindrical body 21, and an edge covering portion 24. The protruding portion 53 is exposed from the escape port 22, and the edge covering portion 24 covers the escape groove 52, so that a surface of the protruding portion 53 is flush with a surface of the edge covering portion 24.

A process of manufacturing the atomizing device of the present disclosure is as follows:

In the presence of the lead wires 33: first, the sealing member 60 is integrally formed on the closure member 40; then, the lead wires 33 are inserted into the electrodes 56 for electrical connection; the atomizing core 30 is mounted into the first sealing portion 61 of the sealing member 60; then the base 50 is snapped with the closure member 40 to clamp the atomizing core 30; then e-liquid is injected into the e-liquid storage cavity 12 of the cartridge tube 10, and the closure member 40, the base 50, and the atomizing core 30 therein are inserted into the cartridge tube 10; at this time, the second sealing portion 63 of the sealing member 60 is clamped between the closure member 40 and an inner wall surface of the cartridge tube 10 to prevent seepage; the third sealing portion 64 of the sealing member 60 is clamped between an outer wall surface of an end portion of the flue 13 and an inner wall surface of the connection air passage 453 to prevent seepage; finally, the cover body 20 covers the base 50, and the fourth snapping portion 23 is snapped with the first snapping portion 141 of the cartridge tube 10.

In the absence of the lead wires 33: in this case, the atomizing core 30 is first combined with the sealing member 60 in the closure member 40, and then the base 50 is snapped with the closure member 40.

According to the atomizing device of the present disclosure, the sealing member 60 is integrally formed on the closure member 40, to avoid the defect that separated silica gel needs to be manually assembled and cannot be automatically assembled. Meanwhile, the sealing member 60 includes first, second, and third sealing portions 61, 63, and 64 to respectively achieve sealing of the outer periphery of the atomizing core 30, between the closure member 60 and the cartridge tube 10, and between the flue 13 and the e-liquid storage cavity 12*p*; moreover, the three sealing portions are integrally provided, and are injection-molded in one time in the closure member during injection molding. When molding the sealing member 60, only one injection point needs to be provided, thereby reducing injection molding costs.

According to the electronic atomizer of the present disclosure, a power supply is connected to the atomizing device, so that a current is conducted to the heating element 33 through the electrodes 56 to heat the heating element 33 and atomize e-liquid attached to a bottom surface of the atomizing core 30 to produce smoke.

The electronic cigarette of the present disclosure is formed by inserting the atomizing device into an electronic cigarette pole. The electronic cigarette pole is integrated with a controller, a control circuit, a power supply, and so on.

Embodiment 2

Figure 8:
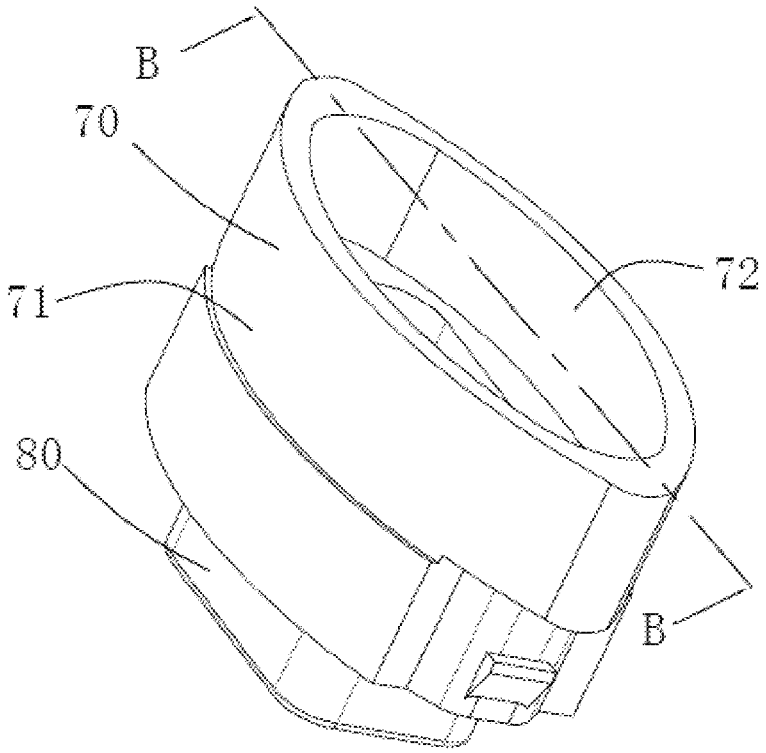
FIG. 8 is an assembled perspective view of an atomizing core and a closure member of an atomizing device according to Embodiment 2 of the present disclosure.
Figure 9:
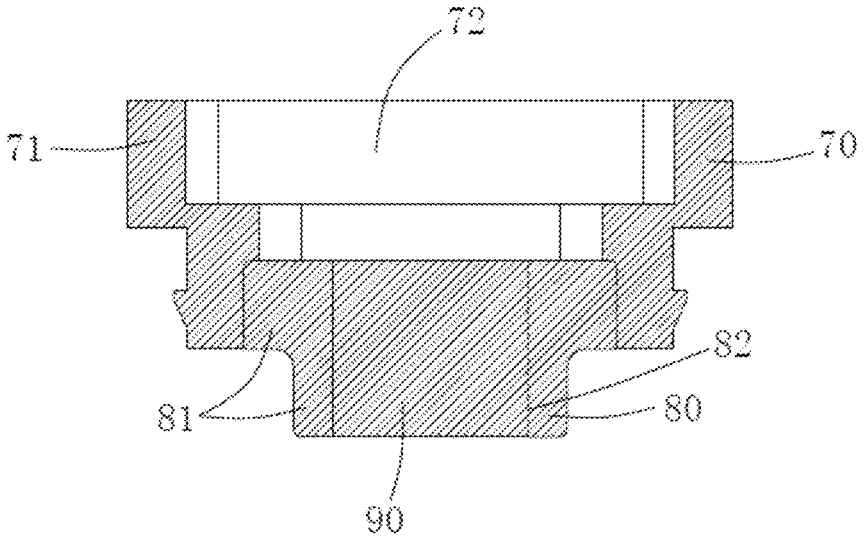
FIG. 9 is a cross-sectional view taken along a dashed line B-B in FIG. 8.

Referring to FIG. 8 and FIG. 9, an atomizing core according to Embodiment 2 includes a ceramic matrix 80 and a ceramic core 90 located inside the ceramic matrix 80. The ceramic matrix 80 is made of zirconia ceramic, namely a dense ceramic material, and will not seep. The ceramic core 90 is made of made of porous ceramic, that is, there is a pore structure inside the ceramic core 90, and capillarity will be generated. The ceramic matrix 80 includes a frame body 81 and a core cavity 82 vertically penetrating through the frame body 81. During manufacturing, the ceramic matrix 80 is first formed, then the core cavity 82 is filled with a porous ceramic material, and finally the porous ceramic material is sintered to form the ceramic core 90.

The atomizing device according to Embodiment 2 includes the atomizing core and a closure member 70. An outer side surface of the ceramic matrix 80 of the atomizing core is integrally formed on the closure member 70 to prevent liquid leakage, and there is no need to provide a sealing member. The closure member 70 is made of a plastic material and includes an outer wall 71 and a cavity 72 enclosed by the outer wall 71. An upper surface of the ceramic core 90 is exposed within the cavity 72. An outer side surface of an outer frame body of the ceramic matrix 80 and an inner side surface of the outer wall 71 are integrally injection-molded.

Surface treatment need to be carried out in advance on an outer side surface, which requires injection molding, of the ceramic matrix 80, so as to form a plurality of reinforcing bonds between the plastic material and the zirconia ceramic at the outer side surface of the frame body 81. The treatment on the outer surface of the zirconia ceramic may be obtained with reference to Patent Application No. 201710109397.1 of the People's Republic of China. Certainly, the treatment on the outer surface of the zirconia ceramic will not be limited to the content disclosed in the Patent Application No. 201710109397.1, and other existing technology for surface treatment on the zirconia ceramic surface may also be adopted.

A manufacturing method of the atomizing device according to Embodiment 2 is as follows.

In S10, a ceramic matrix 80 with a core cavity 82 is provided, and the core cavity 82 is filled with a porous ceramic material.

In this step, the ceramic matrix 80 is zirconia ceramic, with quite high hardness and density, and will not seep or crack.

In S20, the porous ceramic material in the ceramic matrix 80 and the core cavity 82 is sintered to form a ceramic core 90 located in the core cavity 82.

In this step, the obtained ceramic core 90 is provided with micropores, and the micropores will generate capillarity for e-liquid to pass through.

In S30, an outer surface of the ceramic matrix 80 is corroded to form a plurality of nano holes at the outer surface of the ceramic matrix 80.

This step is disclosed in previous patent technical documents, mainly to facilitate the subsequent injection molding process.

In S40, the treated ceramic matrix 80 is nano injection-molded to form a closure member 70.

A bonding surface of the ceramic matrix 80 and the closure member 70 is the surface treated by S30, that is, a plurality of nano-pore structures are formed, by corrosion, at the bonding surface of the ceramic matrix 80.

According to the atomizing device in Embodiment 2, the ceramic core 90 made of a porous ceramic material is directly sintered at the middle of the ceramic matrix 80, which solves the technical problem that the porous ceramic is not strong enough and thus is easy to be broken by extrusion. Meanwhile, the ceramic matrix 80 is directly integrally formed with the closure member 70 by zirconia ceramic, and seepage can be prevented without any sealing member between the closure member 70 and the ceramic matrix 80. Also, removal of the sealing member makes it easier to automatically assemble the atomizing device of the present disclosure.

The above descriptions are merely embodiments of the present disclosure, and are not intended to limit the present disclosure. For those skilled in the art, the present disclosure may have various alterations and changes. Any modification, equivalent replacement, improvement, and the like made within the principle of the present disclosure shall fall within the scope claimed by the claims of the present disclosure.

What is claimed is:

1. An electronic atomizer, comprising: a cartridge tube provided with an e-liquid storage cavity and a flue, a closure member closing the e- liquid storage cavity, a sealing member, an atomizing core provided in the closure member, and a base; the closure member comprising a closure end, an accommodation end extending downward from the closure end, a flow passage vertically penetrating through the closure member, and an air passage separated from the flow passage, wherein the sealing member is integrally formed on the closure member, and the sealing member comprises: a first sealing portion covering an outer side of the atomizing core, a second sealing portion covering an outer periphery of the closure end and abutting against an inner wall surface of the cartridge tube, and a third sealing portion fitted to a top end of the air passage and abutting against an end edge of the flue; and the e-liquid storage cavity is communicated with an upper end surface of the atomizing core through the flow passage, wherein the first sealing portion and the second sealing portion of the sealing member are connected together through a first connecting portion, and the second sealing portion and the third sealing portion of the sealing member are connected together through a second connecting portion.

2. The electronic atomizer according to claim 1, wherein the base is mutually snapped with the sealing member to clamp the atomizing core, the base is provided with a plurality of electrodes for connecting a power supply, and the base is further provided with an air hole.

3. The electronic atomizer according to claim 2, wherein the atomizing core comprises a ceramic matrix and a heating element affixed to a bottom of the ceramic matrix; the ceramic matrix comprises a head and a tail extending from the head; the head is installed into the first sealing portion of the sealing member; when the base is snapped with the closure member, an elastic portion is provided at an end of each of the plurality of electrodes close to the heating element, and the elastic portion abuts against the heating element to conduct electric energy to the heating element.

4. The electronic atomizer according to claim 3, wherein the accommodation end is provided with an accommodation cavity, and the first sealing portion is formed in the accommodation cavity; the first sealing portion comprises: a first fitting portion formed around an inner wall of the accommodation cavity, an opening vertically penetrating through the first sealing portion, and a second fitting portion formed at an outer periphery of the opening and fitted to a bottom wall of the accommodation cavity; a head portion of the atomizing core and the inner wall of the accommodation cavity clamp the first fitting portion, and the head portion of the atomizing core and a bottom surface of the accommodation cavity clamp the second fitting portion; and the flow passage is communicated to an upper surface of the atomizing core through the opening.

5. The electronic atomizer according to claim 4, wherein the head portion of the atomizing core is provided with an e-liquid storage cavity, the e-liquid storage cavity is communicated with the flow passage through the opening of the first sealing portion, the atomizing core is made of porous ceramic, and the atomizing core permeates e-liquid and generates capillarity.

6. The electronic atomizer according to claim 4, wherein a top outer edge of the closure end of the closure member is provided with a closure groove, the second sealing portion comprises a third fitting portion formed at an outer periphery of the closure groove, and the third fitting portion is clamped between the closure groove and the inner wall surface of the cartridge tube;

wherein the third sealing portion comprises a fifth fitting portion formed at an inner wall surface of the top end of the air passage, and a free end of the flue is inserted into the top end of the air passage and clamps, with an inner wall surface of the air passage, the fifth fitting portion.

7. The electronic atomizer according to claim 6, wherein the first connecting portion is connected to the first sealing portion and extends upward from an inner wall surface of the flow passage to a top end of the flow passage to be connected to the second sealing portion at the closure groove, and the second connecting portion extends in parallel from the second sealing portion to be connected to the third sealing portion.

8. The electronic atomizer according to claim 7, wherein a first groove is formed between the closure groove and the top end of the air passage, and the second connecting portion extends from the first groove to connect the second sealing portion with the third sealing portion; a second groove is formed between the closure groove and the flow passage, and the first connecting portion extends to the top end of the flow passage and then is connected to the second sealing portion through the second groove.

9. An assembly method of an electronic atomizer, comprising the following steps:

S10, providing a closure member with a sealing member, an atomizing core provided with a heating element at a bottom surface, and a base; and the atomizing core being accommodated between the closure member and the base, the sealing member comprising a first sealing portion clamped between the atomizing core and the closure member, the base being provided with an air hole and an electrode electrically connected to the heating element of the atomizing core, and the closure member being provided with a flow passage and an air passage independent of the flow passage;

S20, providing a cartridge tube, the cartridge tube being provided with an e-liquid storage cavity and a flue; and injecting e-liquid into the e-liquid storage cavity of the cartridge tube; and S30, inserting an assembly obtained in S10 into the cartridge tube to close the cartridge tube, the flow passage being communicated with the e-liquid storage cavity and the atomizing core; the air passage being communicated with the flue and the air hole, the sealing member further comprising a second sealing portion clamped between an outer periphery of the closure member and an inner wall surface of the cartridge tube and a third sealing portion clamped between an inner wall surface of a top end of the air passage and an outer wall surface of a free end of the cartridge tube, wherein the first sealing portion and the second sealing portion of the sealing member are connected together through a first connecting portion, and the second sealing portion and the third sealing portion of the sealing member are connected together through a second connecting portion.

10. The assembly method of an electronic atomizer according to claim 9, wherein the closure member further comprises: a closure end, an accommodation end extending downward from the closure end, and a closure groove disposed at an outer periphery of a top of the closure end; the first connecting portion is connected to the first sealing portion and extends upward from an inner wall surface of the flow passage to a top end of the flow passage to be connected to the second sealing portion at the closure groove; and the second connecting portion extends in parallel from the second sealing portion to be connected to the third sealing portion; and wherein a first groove is formed between the closure groove and the top end of the air passage, and the second connecting portion extends from the first groove to connect the second sealing portion with the third sealing portion; and a second groove is formed between the closure groove and the flow passage, and the first connecting portion extends to the top end of the flow passage and then is connected to the second sealing portion through the second groove.

11. An electronic cigarette, comprising a cigarette pole and an electronic atomizer inserted to the cigarette pole; the electronic atomizer comprising: a cartridge tube provided with an e-liquid storage cavity and a flue, a closure member closing the e-liquid storage cavity, a sealing member, an atomizing core provided in the closure member, and a base; the closure member comprising a closure end, an accommodation end extending downward from the closure end, a flow passage vertically penetrating through the closure member, and an air passage separated from the flow passage; wherein a bottom surface of the atomizing core is provided with a heating element, and the base is provided with electrodes electrically connected to the heating element; at least four of the electrodes are electrically connected to contact points of the heating element, and a circuit of the cigarette pole is electrically connected to at least two of the electrodes to enable the electronic atomizer to be applicable to different cigarette poles to achieve different flavors.

12. The electronic cigarette according to claim 11, wherein the cigarette pole comprises a power supply, a controller, and the circuit, and the circuit of the cigarette pole is electrically connected to at least two of the electronic atomizers.

13. The electronic cigarette according to claim 12, wherein the atomizing core comprises: a ceramic matrix, a heating element affixed to the ceramic matrix, and lead wires connected to the heating element; the ceramic matrix comprises a head and a tail extending from the head; the heating element extends from a bottom surface and a side surface of the tail; the lead wires are led out from the bottom surface and the side surface of the tail; and the lead wires are curled and then inserted into the electrodes.

14. The electronic cigarette according to claim 13, wherein the atomizing core comprises the ceramic matrix and the heating element affixed to the ceramic matrix, an elastic portion is provided at an end of each of the electrodes close to the heating element, and the elastic portion abuts against the heating element to conduct electric energy to the heating element.

15. The electronic cigarette according to claim 13, wherein the sealing member is integrally formed on the closure member, and the sealing member comprises: a first sealing portion covering an outer side of the atomizing core, a second sealing portion covering an outer periphery of the closure end and abutting against an inner wall surface of the cartridge tube, and a third sealing portion fitted to a top end of the air passage and abutting against an end edge of the flue; the e-liquid storage cavity is communicated with an upper end surface of the atomizing core through the flow passage; the base is mutually snapped with the sealing member to clamp the atomizing core; the base is provided with the electrodes for connecting a power supply, and the base is further provided with an air hole.

16. The electronic cigarette according to claim 15, wherein the accommodation end is provided with an accommodation cavity; the first sealing portion is formed in the accommodation cavity, and the first sealing portion comprises: a first fitting portion formed around an inner wall of the accommodation cavity, an opening vertically penetrating through the first sealing portion, and a second fitting portion formed at an outer periphery of the opening and fitted to a bottom wall of the accommodation cavity; a head portion of the atomizing core and the inner wall of the accommodation cavity clamp the first fitting portion; the head portion of the atomizing core and a bottom surface of the accommodation cavity clamp the second fitting portion; and the flow passage is communicated to an upper surface of the atomizing core through the opening.

17. The electronic cigarette according to claim 16, wherein a top outer edge of the closure end of the closure member is provided with a closure groove, the second sealing portion comprises a third fitting portion formed at an outer periphery of the closure groove, and the third fitting portion is clamped between the closure groove and the inner wall surface of the cartridge tube.

18. The electronic cigarette according to claim 17, wherein the third sealing portion comprises a fifth fitting portion formed at an inner wall surface of the top end of the air passage, and a free end of the flue is inserted into the top end of the air passage and clamps, with an inner wall surface of the air passage, the fifth fitting portion.

19. The electronic cigarette according to claim 18, wherein the first sealing portion and the second sealing portion of the sealing member are connected together through a first connecting portion, and the second sealing portion and the third sealing portion of the sealing member are connected together through a second connecting portion; the first connecting portion is connected to the first sealing portion and extends upward from an inner wall surface of the flow passage to a top end of the flow passage to be connected to the second sealing portion at the closure groove, and the second connecting portion extends in parallel from the second sealing portion to be connected to the third sealing portion.

20. The electronic cigarette according to claim 19, wherein a first groove is formed between the closure groove and the top end of the air passage, and the second connecting portion extends from the first groove to connect the second sealing portion and the third sealing portion; a second groove is formed between the closure groove and the flow passage, and the first connecting portion extends to the top end of the flow passage and then is connected to the second sealing portion through the second groove.

* * * * *